US007575140B2

(12) United States Patent
Jiang

(10) Patent No.: US 7,575,140 B2
(45) Date of Patent: Aug. 18, 2009

(54) ABUTMENT ADJUSTING DEVICE FOR NAIL GUN

(75) Inventor: Ming-Tsang Jiang, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 42 days.

(21) Appl. No.: 11/863,415

(22) Filed: Sep. 28, 2007

(65) Prior Publication Data

US 2009/0084824 A1 Apr. 2, 2009

(51) Int. Cl.
*B25C 7/00* (2006.01)

(52) U.S. Cl. ..... 227/110; 227/119; 227/156

(58) Field of Classification Search ..... 227/110, 227/119, 156, 140
See application file for complete search history.

(56) References Cited

U.S. PATENT DOCUMENTS 2,915,754 A * 12/1959 Wandel ..... 227/5
3,570,738 A * 3/1971 Pabich et al. ..... 227/8
3,670,941 A * 6/1972 Grinnell et al. ..... 227/8
3,708,640 A * 1/1973 Fuller ..... 200/314
4,126,258 A * 11/1978 Martin et al. ..... 227/8
4,389,012 A * 6/1983 Grikis et al. ..... 227/120
4,572,715 A * 2/1986 Wolff ..... 409/180
4,655,653 A * 4/1987 Hall et al. ..... 409/182
4,729,698 A * 3/1988 Haddon ..... 408/110
5,054,678 A * 10/1991 Nasiatka ..... 227/8
5,150,993 A * 9/1992 Miller ..... 408/110
5,165,827 A * 11/1992 Miller ..... 408/16
5,261,588 A * 11/1993 Lin ..... 227/110
5,628,445 A * 5/1997 Braddock et al. ..... 227/151
5,683,024 A * 11/1997 Eminger et al. ..... 227/8
6,161,744 A * 12/2000 Mukoyama et al. ..... 227/8
6,631,836 B2 * 10/2003 Dickhaut ..... 227/148
6,824,036 B2 * 11/2004 Walter ..... 227/120
6,843,402 B2 * 1/2005 Sims et al. ..... 227/148
2005/0263560 A1 * 12/2005 Niblett et al. ..... 227/135

* cited by examiner

*Primary Examiner*—Brian D Nash

(57) ABSTRACT

An abutment adjusting device for a nail gun has a horizontal sliding rail disposed on a bottom side of a nail cartridge of the nail gun. The sliding rail has multiple positioning grooves. An abutment having a containing groove opening upward is disposed on the sliding rail. The containing groove has two groove sidewalls, each of which has at least a vertical guiding channel for slidably disposing a sliding block in the containing groove. The sliding block has a top having at least a protruding part corresponding to the positioning grooves. A first elastic unit is disposed in the containing groove for driving the sliding block to move upward and further drive the protruding part to be engaged into the positioning grooves so as to position the abutment. Thereby, a user can press the sliding block to drive the protruding part to be disengaged from the positioning groove and to release the positioning groove, move the abutment to an appropriate position and release the sliding block to drive the protruding part to be engaged with the positioning groove and to position the abutment for another time.

12 Claims, 9 Drawing Sheets

ABUTMENT ADJUSTING DEVICE FOR NAIL GUN

BACKGROUND

The present invention relates to an abutment device, and more particularly to an abutment device of a nail gun disposed on a bottom side of a nail cartridge of a nail gun, and a technique for positioning, releasing and adjusting a displacement of an abutment device of a nail gun.

A pneumatic driven nail gun is a high pressure air driven tool for shooting nails on a workpiece. It has been widely used in nailing jobs on daily items, furniture, buildings and etc.

To nail multiple wood boards or shingles with a conventional nail gun, an operator may align nailing positions on the multiple wood boards or shingles in accordance with a single straight line by eye measurement, or alternatively, the operator may measure and mark a straight line on the multiple wood boards or shingles and then shoot nails thereupon with the nail gun along the marked straight line. However, by eye measurement as mentioned above, it is difficult to ensure all the nails are positioned along a perfectly straight line. In addition, measuring and marking a straight line on multiple wood boards or shingles may slow down the speed of overall operation and prolong the overall operation time.

To overcome the above disadvantages, a user may position a protruding structure on a bottom of an nail cartridge of the nail gun such as a protruding block or a side board close to sides of the multiple wood boards or shingles one after another so as to align the nailing position to straight line. The problem with this approach is, however, the position of this protruding structure is generally difficult to adjust. So it is desired to solve this problem.

BRIEF SUMMARY

To overcome the disadvantages of the prior art described above, the present invention provides an abutment adjusting device for a nail gun, which can be used to position an abutment device of a nail gun close to side ends of the multiple wood boards or shingles one by one and use the nail gun to shoot nails thereupon in an aligned straight line. In addition, the alignment position can be adjusted freely and hence the convenience of using the nail gun is improved.

To achieve the above mentioned objective, the abutment adjusting device for a nail gun that the present invention provides includes:

a horizontal sliding rail disposed on a bottom side of an nail cartridge of the nail gun, the sliding rail having a horizontal guiding board on each side thereof, a plurality of positioning grooves opening downward being disposed between the guiding boards;

an abutment having a containing groove opening upward, the containing groove having two groove sidewalls, each of the sidewalls having a horizontal groove and at least a vertical guiding channel, the horizontal grooves being mounted on the guiding board for guiding the abutment to be slidably disposed on the sliding rail;

a sliding block with a top having at least a protruding part corresponding to the positioning grooves, the two sides of the sliding block respectively having at least a vertical ear-board, each ear-board is slidably disposed in the guiding channel for guiding the sliding block to be slidably disposed in the containing groove; and a first elastic unit disposed in the containing groove for driving the sliding block to move upward and further drive the protruding part to be engaged into the positioning grooves so as to position the abutment.

With the present invention, by positioning the abutment close to the sides of the multiple wood boards or shingles one by one, a user can use the nail gun to shot nails thereon in an aligned straight line. In addition, the user can press the sliding block to drive the protruding part to be disengaged from the positioning groove, move the abutment to an appropriate position and release the sliding block to drive the protruding part to be engaged with the positioning groove and to position the abutment for another time so as to improve the speed of nailing and reduce the operating time.

The sliding block can further have a contact part naked on an outside of the abutment on a side end of the sliding block.

In another aspect, the abutment adjusting device for a nail gun of the present invention could include:

a horizontal sliding rail disposed on a bottom side of an nail cartridge of the nail gun, the sliding rail having a horizontal guiding board on each side thereof, a plurality of positioning grooves opening downward being disposed between the guiding boards;

an abutment having a containing groove opening upward, the containing groove having two groove sidewalls, each of the sidewalls having a horizontal groove and at least a vertical guiding channel, the horizontal grooves being mounted on the guiding board for guiding the abutment to be slidably disposed on the sliding rail;

a sliding block with a top having at least a protruding part corresponding to the positioning grooves, the two sides of the sliding block respectively having at least a vertical ear-board, each ear-board is slidably disposed in the guiding channel for guiding the sliding block to be slidably disposed in the containing groove, the sliding block having a tilted guiding groove installed on a side end thereof;

a button horizontally and slidably disposed in the containing groove, the button having a tiled shape and being engaged with a guiding piece in the guiding groove, the button being configured for driving the sliding block moving vertically so as to drive the protruding part to be engaged with or disengaged from the positioning groove; and at least a second elastic unit disposed in the containing groove and configured for driving the button to move and further drive the protruding part to be engaged with the positioning groove so as to position the abutment.

With the present invention, by positioning the abutment close to the sides of the multiple wood boards or shingles one by one, a user can use the nail gun to shot nails thereon in an aligned straight line. In addition, the user can press the button to drive the protruding part to be disengaged from the positioning groove and to release the abutment and can release the button to drive the protruding part to be engaged with the positioning groove and to position the abutment for another time.

The button can further have a contact part naked on an outside of the abutment on a side end of the button.

Furthermore, a protection board can be mounted to the abutment for preventing wearing on bottom and sides of the abutment.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
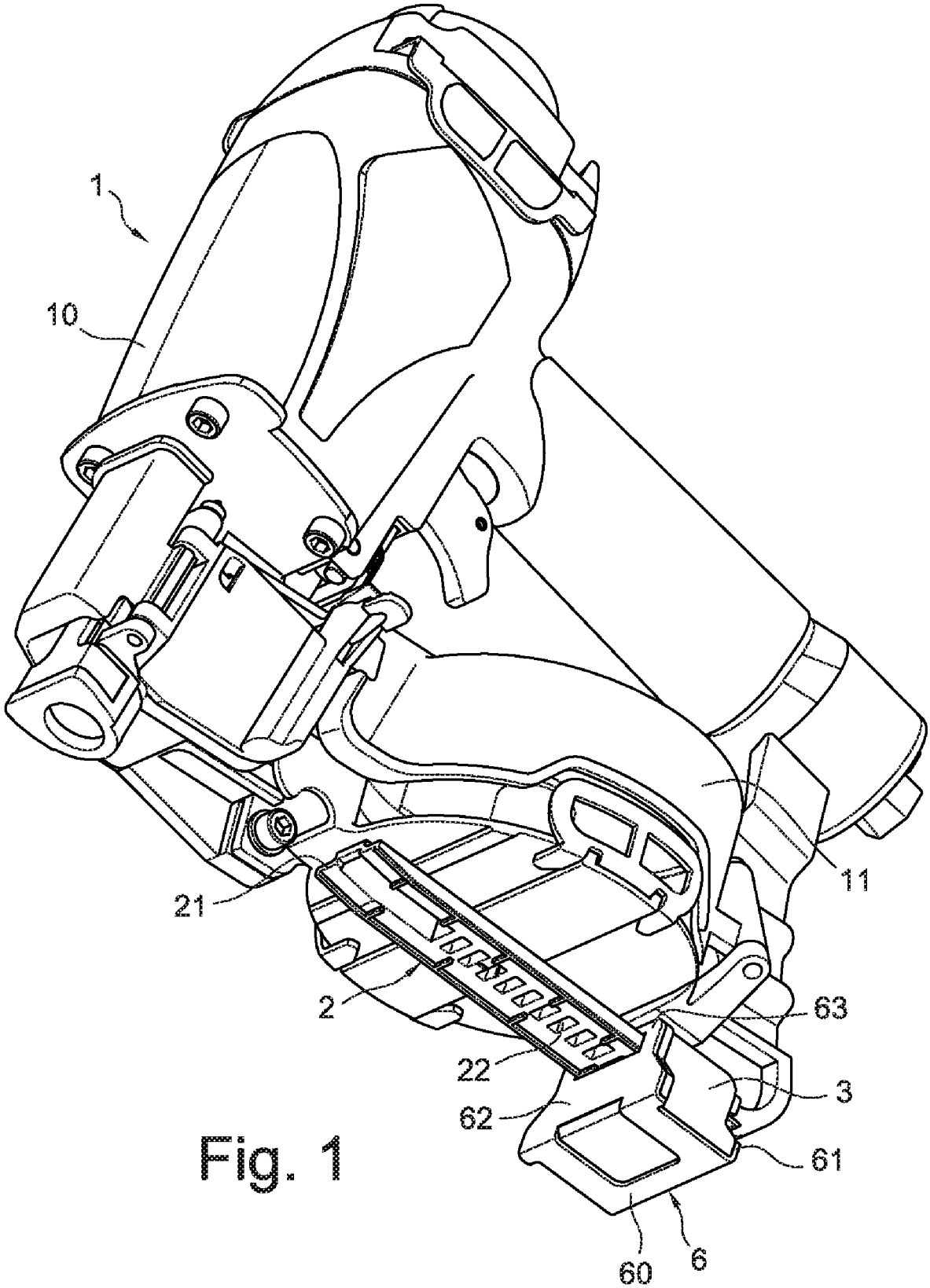
FIG. 1 is a perspective view of an abutment adjusting device for a nail gun in accordance with a first preferred embodiment provided by the present invention.
Figure 2:
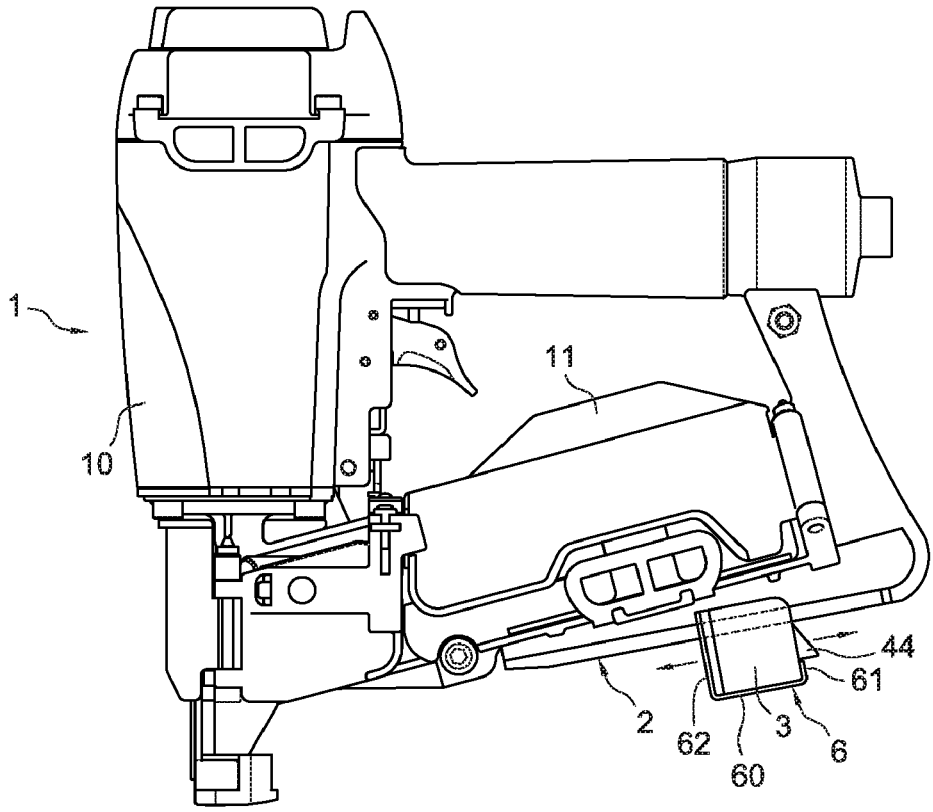
FIG. 2 is a front view of an abutment adjusting device for a nail gun in accordance with a first preferred embodiment provided by the present invention.
Figure 3:
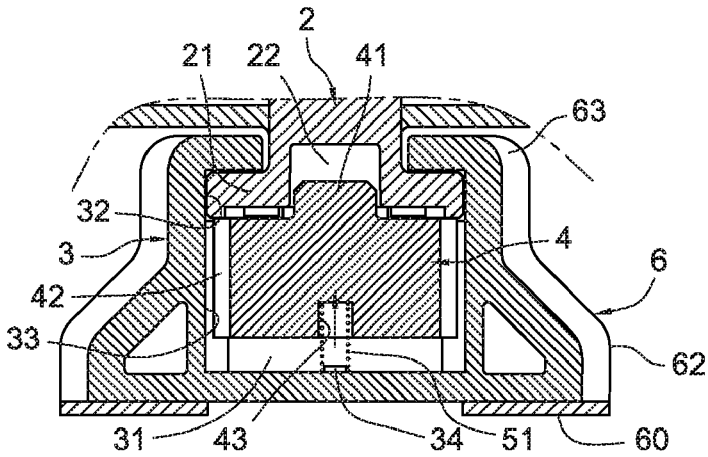
FIG. 3 is cross-sectional view of an abutment adjusting device for a nail gun in accordance with a first preferred embodiment provided by the present invention.

Referring to FIG. 1, an abutment adjusting device for a nail gun in accordance with a first embodiment of the present invention is provided. A nail gun 1 has a nail cartridge 11 and a horizontal sliding rail 2 is disposed on the bottom of the nail cartridge 11. Referring to FIG. 2, a front view of the first embodiment of the present invention, an abutment 3 is slidably disposed on the sliding rail 2. Referring to FIG. 3, a cross-sectional view of the first embodiment of the present invention, two horizontal guiding boards 21 are formed on two sides of the sliding rail 2 (referring to FIG. 1 as well). Multiple positioning grooves 22 are formed opening downward between the guiding boards 21.

Figure 4:
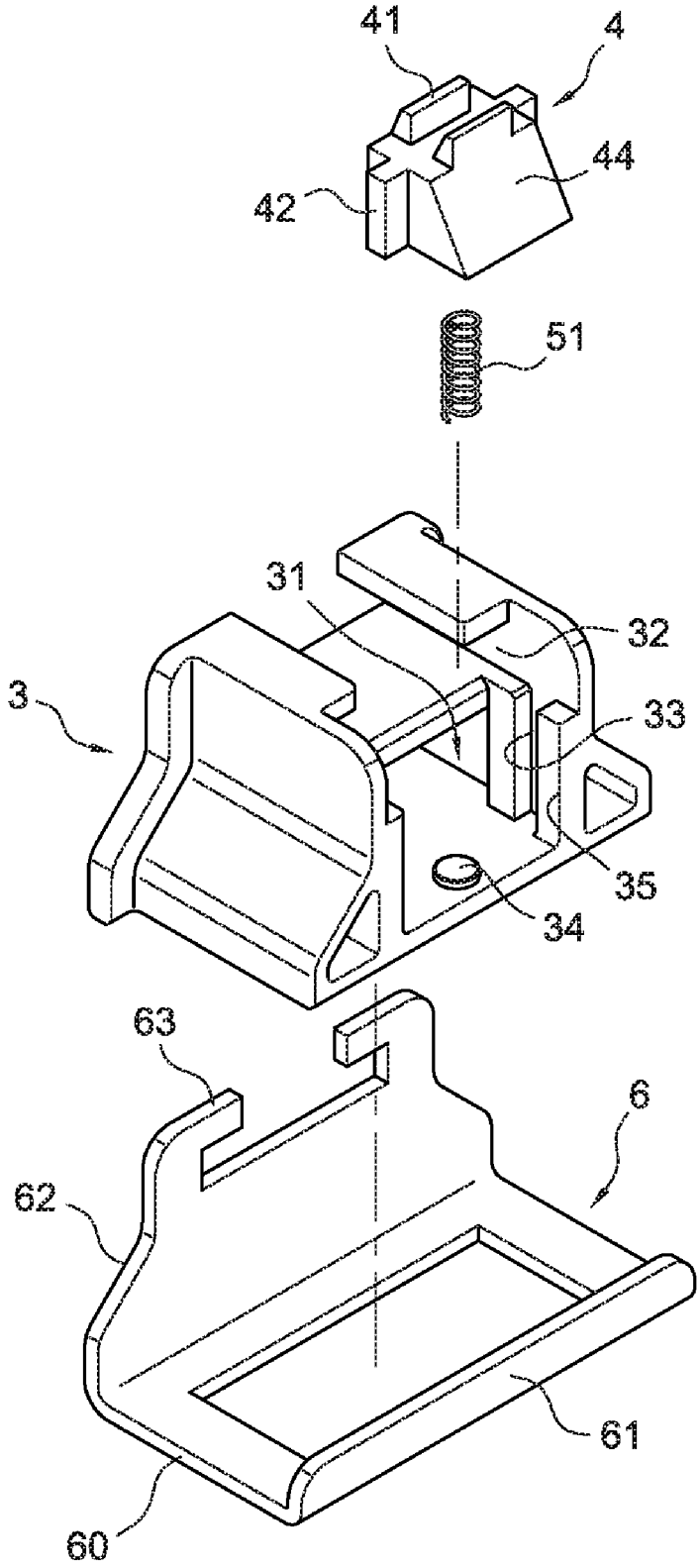
FIG. 4 is an exploded view of an abutment in accordance with a first preferred embodiment provided by the present invention.
Figure 5:
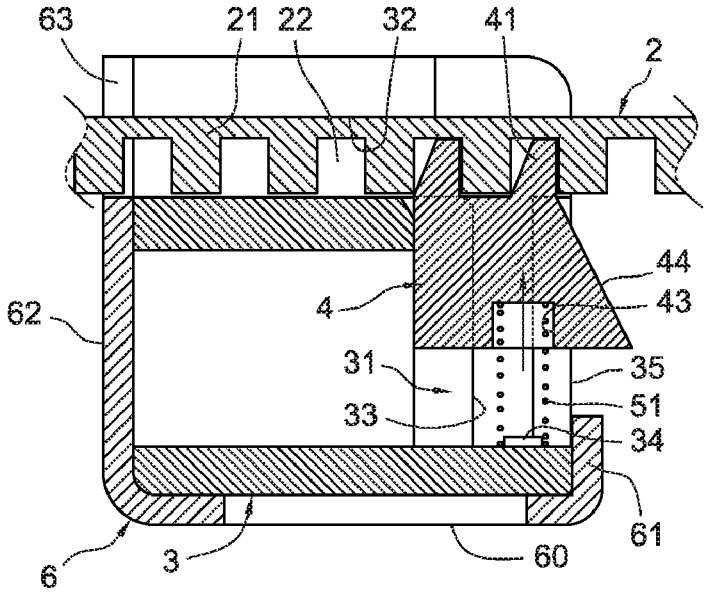
FIG. 5 is a cross-sectional view of an operation state of an abutment adjusting device for a nail gun in accordance with a first preferred embodiment provided by the present invention.

Referring to FIG. 3 to FIG. 5, a containing groove 31 opening upward is disposed on the abutment 3. A horizontal concave groove 32 and at least a vertical guiding channel 33 are disposed on each of the two sidewalls of the containing groove 21. Each concave groove 32 holds the guiding board 21 so as to guide the abutment 3 to slide on the sliding rail 2. A protruding pole 34 is disposed on a bottom of the containing groove 31 and an opening 35 is formed on a side of the containing groove 31. A sliding block 4 is disposed in the containing groove 31.

Referring to FIG. 3 to FIG. 5, at least a protruding part 41 is formed on the top of the sliding block 4 corresponding to the positioning groove 22. In this embodiment, two protruding part 41 are formed. At least a vertical ear-board 42 is formed on each of the two sides of the sliding block 4. Each ear-board 42 is slidably disposed in the guiding channel 33 so as to guide the sliding block 4 to slide in the containing groove 31. A containing hole 43 is formed on the bottom of the sliding block 4 corresponding to the protruding pole 34.

A first elastic unit 51 is disposed in the containing groove 31. Referring to FIG. 3 to FIG. 5, in this embodiment, the first elastic unit 51 is a spring positioned between the protruding pole 34 and the containing hole 43. The first elastic unit 51 can push the sliding block 4, engage the protruding part 41 with the positioning groove 22 of the sliding rail 2 and thereby position the abutment 3 on the sliding rail 2.

More specifically, the present invention also includes the following.

Referring to FIG.2 to FIG. 5, a contact part 44 is formed beside an opening 35 of the abutment 3 on a side of the sliding block 4;

Referring to FIG. 1 to FIG. 5, a protection unit 6 is disposed on the abutment 3 as a frame. The protection unit 6 includes a bottom board 60, a first side board 61 and a second side board 62. The bottom board 60 is configured for preventing the bottom of the abutment 3 from directly contacting and pressing a top 81 of the wood board or shingle 8 and causing wearing thereby. The second side board 62 is installed near to a gun body 10 of the nail gun 1 and configured for preventing a side of the abutment 3 from directly contacting and pressing a side end 82 of the wood board or shingle 8 and causing wearing thereby. Two hook parts 63 are formed on a top of the second side board 62 and configured for slidably mounting the protection unit 6 to the guiding board 21 of the sliding rail 2.

Figure 6:
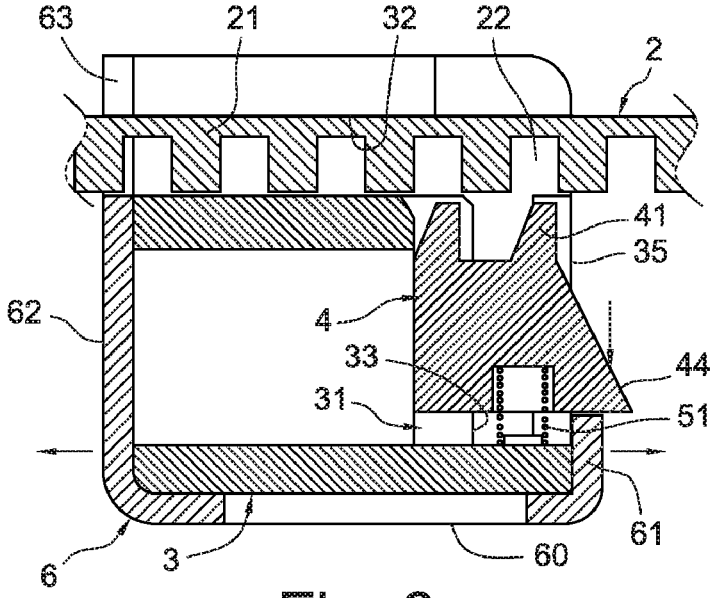
FIG. 6 is a cross-sectional view of another operation state of an abutment adjusting device for a nail gun in accordance with a first preferred embodiment provided by the present invention.
Figure 7:
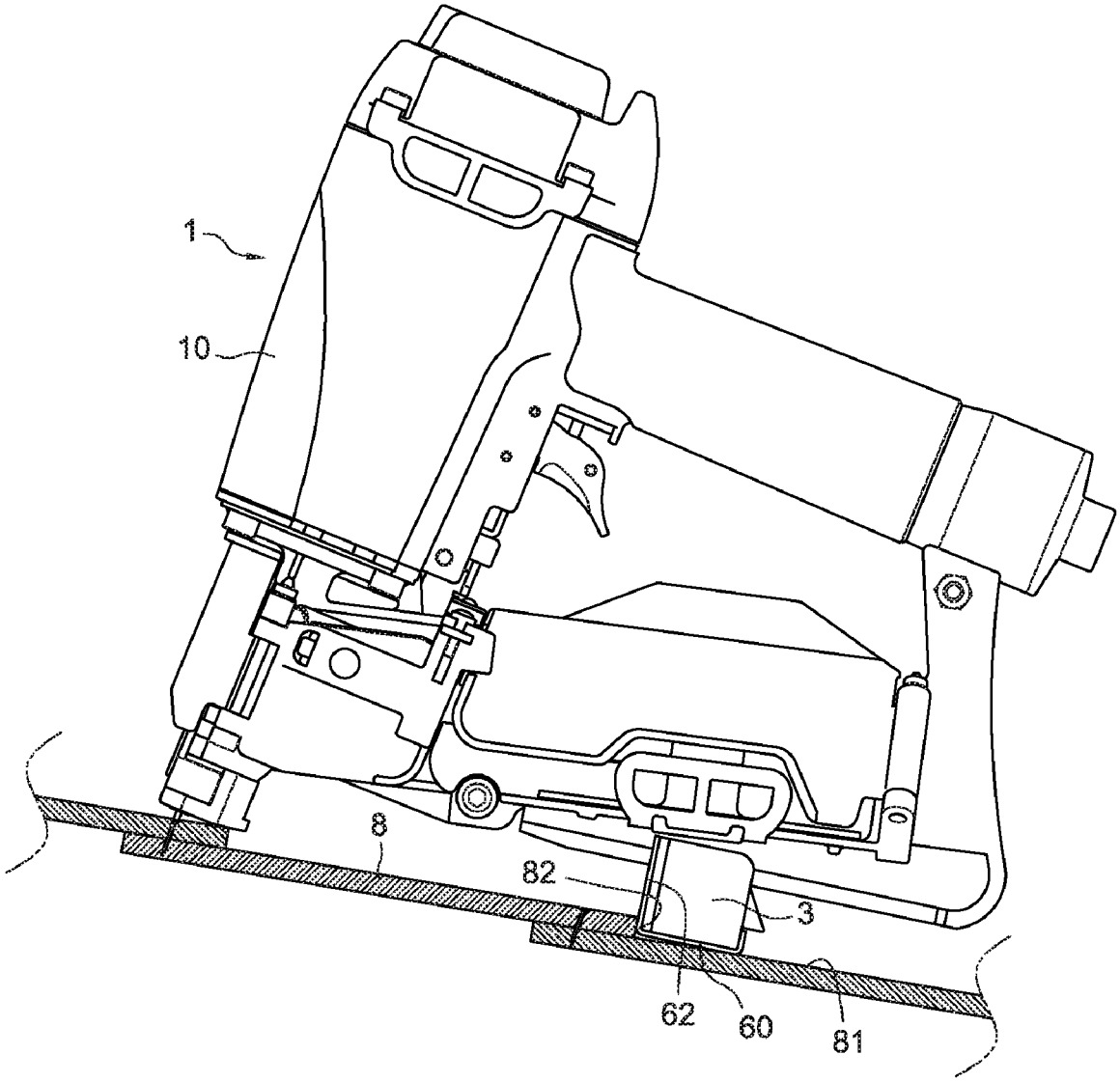
FIG. 7 is a schematic view of an operation state of an abutment adjusting device for a nail gun in accordance with a first preferred embodiment provided by the present invention.

When a user intends to shoot nails upon multiple wood boards or shingles 8 patterned in a scale shape, as shown in FIG. 7, the user can press the contact part 44 naked on an outside of the abutment 3 in a downward direction, as shown in FIG. 6, and thereby drive the protruding part 41 of the sliding block 4 to move downward to be disengaged from the positioning groove 22 of the sliding rail 2 and release the abutment 3. Then the user can horizontally move the abutment 3 to an appropriate position along the sliding rail 2, as shown in FIG. 2. During such movement the contact part 44 keeps being pushed so that the protruding part 41 of the sliding block 4 keeps moving downward till it is disengaged from the positioning groove 22. Next, the user can release the contact part 44 so that it will move upward. As a result, the first elastic unit 51 drives the sliding block 4 upward and pushes the protruding part 41 to engage with the positioning groove 22 of the sliding groove 22. As a result, the abutment 3 is positioned as shown in FIG. 5. This way, by moving the abutment 3 toward the tops 81 and the sides 82 of the multiple wood boards or shingles 8 one by one, the user can use the nail gun 1 to shoot nails thereupon in an aligned straight line.

When a user intends to nail on multiple wood boards or shingles 8 of different sizes patterned in a scale shape, the user can repeat releasing, adjusting and positioning the abutment 3 as mentioned above to horizontally move the abutment 3 along the sliding rail 2 to another appropriate position so as to align the nailing position of the nail gun 1 on multiple wood boards or shingles 8 of different sizes. Hereby, by positioning the abutment 3 close to the tops 81 and the sides 82 of the multiple wood boards or shingles 8 one by one, the user can use the nail gun 1 to shoot nails thereupon in an aligned straight line. In addition, the user can adjust the aligned position freely, which improves the convenience of using the nail gun 1.

Figure 8:
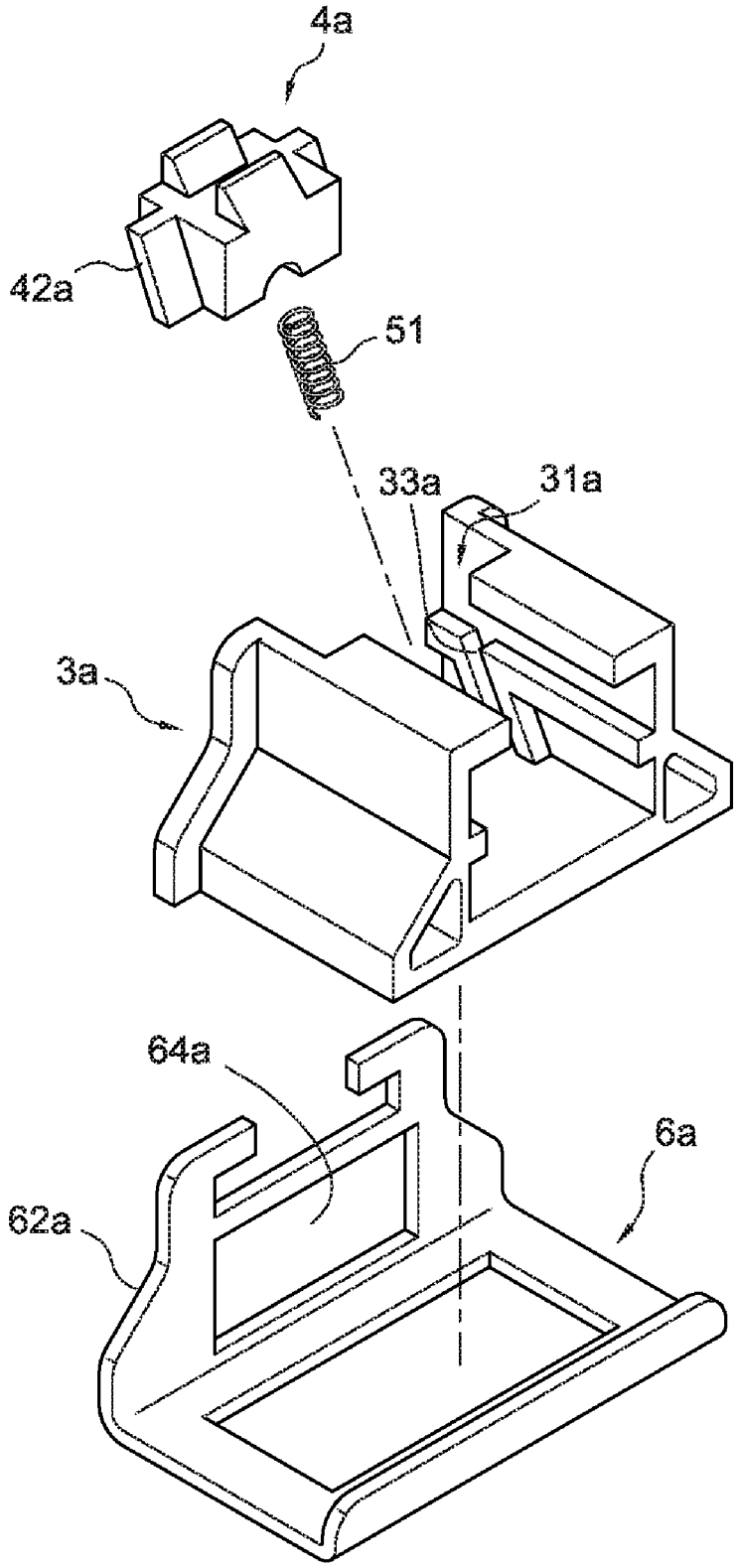
FIG. 8 is an exploded view of an abutment in accordance with a second preferred embodiment provided by the present invention.
Figure 9:
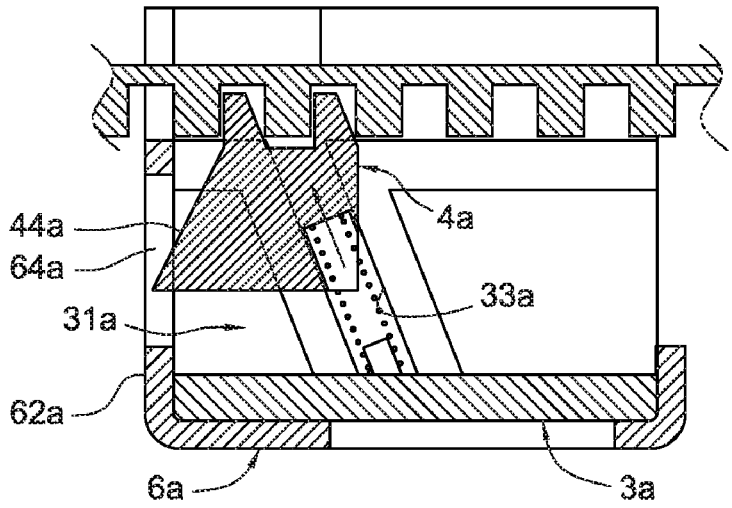
FIG. 9 is a cross-sectional view of an operation state of an abutment adjusting device for a nail gun in accordance with a second preferred embodiment provided by the present invention.
Figure 10:
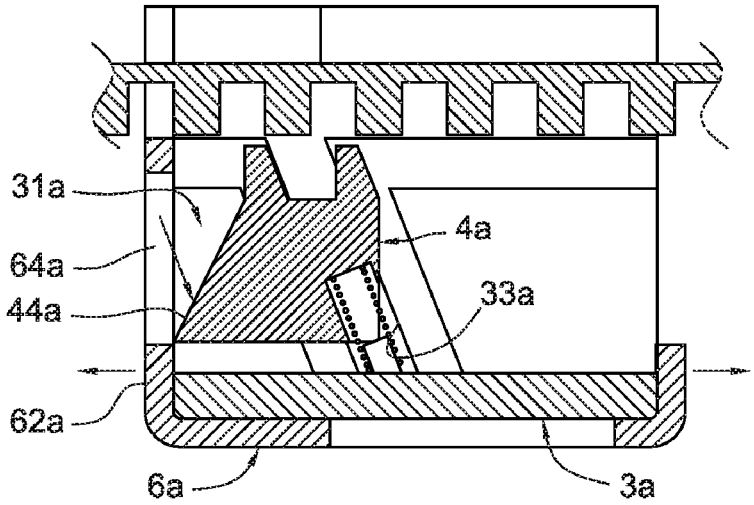
FIG. 10 is a cross-sectional view of another operation state of an abutment adjusting device for a nail gun in accordance with a second preferred embodiment provided by the present invention.

FIG. 8 is an exploded view of the abutment 3*b* provided by a second embodiment of the present invention. FIG. 9 illustrates that the guiding groove 33*a* on the two sides of the containing groove 31*a* of the abutment 3*a* can be tilted by an angle as well. So is the ear-board 42*a*. Referring to FIG. 10, an opening 64*a* is formed on a second side board 62*a* of a protection board 6*a* for allowing a user to put fingers into the opening 64*a* to press or release a contact part 44*a*. The rest components in this embodiment are equivalent to the first embodiment.

Figure 11:
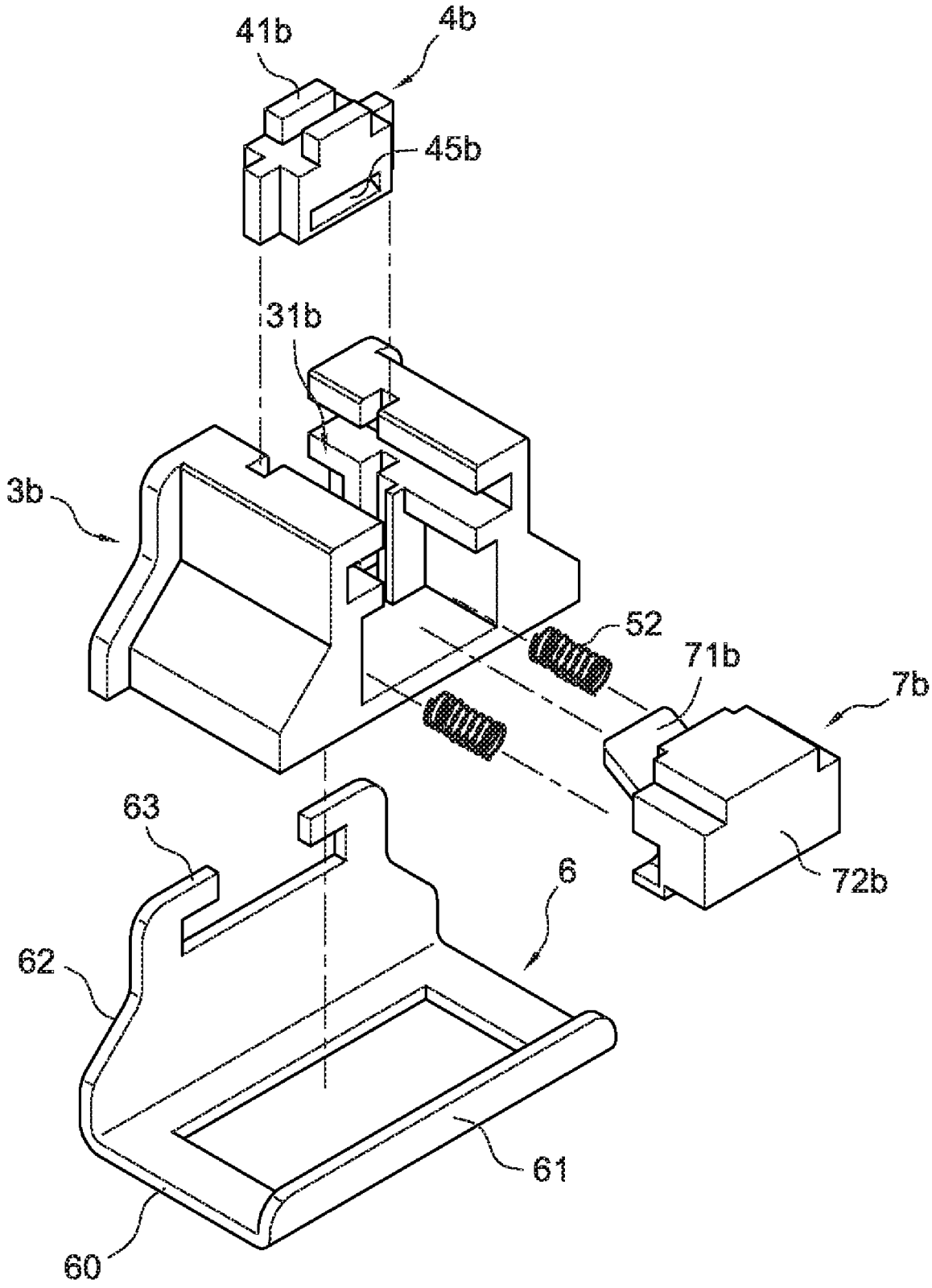
FIG. 11 is an exploded view of an abutment in accordance with a third preferred embodiment provided by the present invention.
Figure 12:
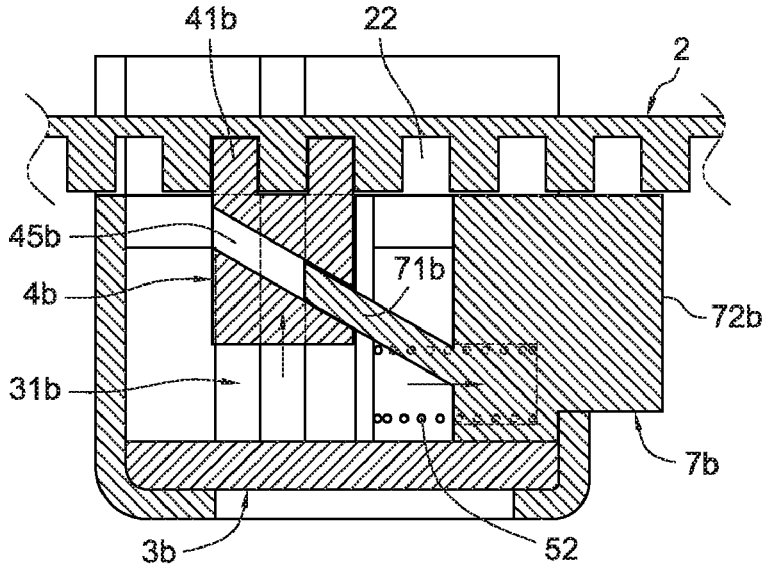
FIG. 12 is a schematic view of an operation state of an abutment adjusting device for a nail gun in accordance with a third preferred embodiment provided by the present invention.
Figure 13:
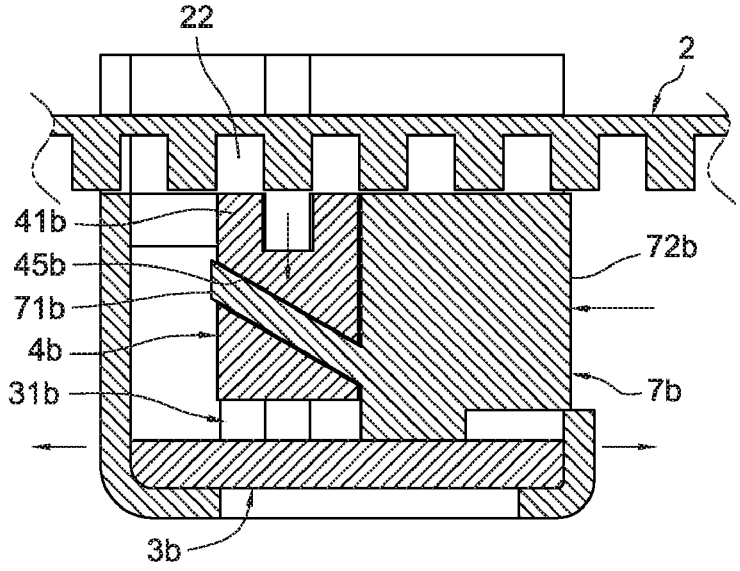
FIG. 13 is a schematic view of another operation state of an abutment adjusting device for a nail gun in accordance with a third preferred embodiment provided by the present invention.

FIG. 11 is an exploded view of the abutment 3*b* provided by a third embodiment of the present invention. FIG. 12 illustrates that no contact part 44 (as shown in FIG. 4) is formed on any side end of a sliding block 4*b*. A tilting guiding groove 45*b* is formed on a side end of the sliding block 4*b*. A button 7*b* is horizontally and slidably installed in the containing groove 31*b*. The button 7*b* has a tilted shape at one end and is implanted into a guiding piece 71*b* in the guiding groove 45*b* for driving the sliding block 4*b* to move vertically which further drives a protruding part 41*b* to be engaged with or disengaged from the positioning groove 22 of the sliding rail 2, as illustrated in FIG. 13. A contact part 72*b* is formed at another end of the button 7*b* naked on an outside of the abutment 3*b*. At least a second elastic unit 52 replaces the first elastic unit 51 (as shown in FIG. 4 and FIG. 5) disposed in the containing groove 31. The second elastic unit 52 is a spring that can drive the button 7*b* to move horizontally, which further drives the protruding part 41*b* to engage with the positioning groove 22 and thereby to position the abutment 3*b*. The rest components in this embodiment are equivalent to the first embodiment.

This way, referring to FIG. 7, by moving the abutment 3 toward the tops 81 and the sides 82 of the multiple wood boards or shingles 8 one by one, the user can use the nail gun 1 to shot nails thereon in an aligned straight line. Referring to FIG. 13, by pressing the button 7*b*, the user can move the protruding part 41*b* of the sliding block 4*b* to be disengaged from the positioning groove 22 so as to release the abutment 3*b* to allow it to move to another appropriate position on the sliding rail 2 (as shown in FIG. 2). Referring to FIG. 12, by releasing the button 7*b*, the second elastic unit 52 can drive the protruding part 41*b* of the sliding block 4*b* to be engaged with the positioning groove 22 for positioning the abutment 3*b* for another time. The rest operations of the embodiment are equivalent to the first embodiment.

In summary, it is known in the present invention a sliding rail 2 is disposed on a bottom side of a nail cartridge 11 of a nail gun 1. An abutment 3 designed to have positioning, releasing and displacement adjustment functions is slidably disposed on the sliding rail 2. When the nail gun 1 is used to shoot nails on multiple wood boards or shingles 8 of different sizes patterned in a scale shape, the speed of such operation is improved and the working time thereof is reduced.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An abutment adjusting device for a nail gun, comprising:

a horizontal sliding rail disposed on a bottom side of an nail cartridge of the nail gun, the sliding rail having a horizontal guiding board on each side thereof, a plurality of positioning grooves opening downward being disposed between the guiding boards;

an abutment having a containing groove opening upward, the containing groove having two groove sidewalls, each of the sidewalls having a horizontal groove and at least a vertical guiding channel, the horizontal grooves being mounted on the guiding board for guiding the abutment to be slidably disposed on the sliding rail;

a sliding block with a top having at least a protruding part corresponding to the positioning grooves, the two sides of the sliding block respectively having at least a vertical ear-board, each ear-board is slidably disposed in the guiding channel for guiding the sliding block to be slidably disposed in the containing groove; and a first elastic unit disposed in the containing groove for driving the sliding block to move upward and further drive the protruding part to be engaged into the positioning grooves so as to position the abutment.

2. The abutment adjusting device for a nail gun of claim 1, wherein the sliding block has a contact part which extends outside of the abutment on a side end of the sliding block.

3. The abutment adjusting device for a nail gun of claim 1, wherein a protection board is mounted to the abutment for preventing wearing on bottom and sides of the abutment.

4. The abutment adjusting device for a nail gun of claim 1, wherein a protruding pole is disposed on a bottom of the containing groove, and a containing hole is formed on a bottom of the sliding block corresponding to the protruding pole, the first elastic unit is positioned between the protruding pole and the containing hole.

5. The abutment adjusting device for a nail gun of claim 4, wherein the first elastic unit is a spring which extends between the protruding pole and the containing hole along an axes of the spring.

6. The abutment adjusting device for a nail gun of claim 5, wherein the spring vertically extends between the protruding pole and the containing hole along the axes of the spring.

7. The abutment adjusting device for a nail gun of claim 5, wherein the spring extends slantways from the protruding pole to the containing hole along the axes of the spring.

8. The abutment adjusting device for a nail gun of claim 1, wherein the horizontal groove and the at least a vertical guiding channel of each of the sidewalls of the containing groove intersect with each other.

9. An abutment adjusting device for a nail gun, comprising:

a horizontal sliding rail disposed on a bottom side of an nail cartridge of the nail gun, the sliding rail having a horizontal guiding board on each side thereof, a plurality of positioning grooves opening downward being disposed between the guiding boards;

an abutment having a containing groove opening upward, the containing groove having two groove sidewalls, each of the sidewalls having a horizontal groove and at least a vertical guiding channel, the horizontal grooves being mounted on the guiding board for guiding the abutment to be slidably disposed on the sliding rail;

a sliding block with a top having at least a protruding part corresponding to the positioning grooves, the two sides of the sliding block respectively having at least a vertical ear-board, each ear-board is slidably disposed in the guiding channel for guiding the sliding block to be slidably disposed in the containing groove, the sliding block having a tilted guiding groove installed on a side end thereof;

a button horizontally and slidably disposed in the containing groove, the button having a tiled shape and being engaged with a guiding piece in the guiding groove, the button being configured for driving the sliding block moving vertically so as to drive the protruding part to be engaged with or disengaged from the positioning groove; and at least a second elastic unit disposed in the containing groove and configured for driving the button to move and further drive the protruding part to be engaged with the positioning groove so as to position the abutment.

10. The abutment adjusting device for a nail gun of claim 9, wherein the button has a contact part which extends outside of the abutment on a side end of the button.

11. The abutment adjusting device for a nail gun of claim 9, wherein the second elastic unit is a spring which horizontally positioned in the containing groove along an axes of the spring and contacts the button.

12. The abutment adjusting device for a nail gun of claim 9, wherein the horizontal groove and the at least a vertical guiding channel of each of the sidewalls of the containing groove intersect with each other.

* * * * *